US007261080B2

(12) United States Patent
Chonan et al.

(10) Patent No.: US 7,261,080 B2
(45) Date of Patent: Aug. 28, 2007

(54) OIL COOLING SYSTEM OF AN AIR-COOLED ENGINE

(75) Inventors: Mitsugi Chonan, Tokyo (JP); Toshiyuki Matsushima, Tokyo (JP)

(73) Assignee: Fuji Jukogyo Kabushiki Kaisha (JP)

( * ) Notice: Subject to any disclaimer, the term of this patent is extended or adjusted under 35 U.S.C. 154(b) by 0 days.

(21) Appl. No.: 11/393,049

(22) Filed: Mar. 30, 2006

(65) Prior Publication Data

US 2006/0219208 A1 Oct. 5, 2006

(30) Foreign Application Priority Data

Mar. 31, 2005 (JP) ..... 2005-100519

(51) Int. Cl.
*F01M 5/00* (2006.01)

(52) U.S. Cl. ..... 123/196 AB; 165/916; 184/104.3

(58) Field of Classification Search ..... 123/196 AB; 165/916; 184/104.3
See application file for complete search history.

(56) References Cited

U.S. PATENT DOCUMENTS 3,800,868 A * 4/1974 Berkowitz et al. ..... 165/170
5,351,664 A * 10/1994 Rotter et al. ..... 123/196 AB

FOREIGN PATENT DOCUMENTS

JP 09-296991 11/1997
JP 2002-225574 8/2002

* cited by examiner

*Primary Examiner*—Noah P. Kamen
(74) *Attorney, Agent, or Firm*—Smith, Gambrell & Russell, LLP

(57) ABSTRACT

An oil cooling system of an air-cooled engine for cooling the oil reserved in a crankcase of the engine comprises a base plate assembled to the crankcase, an overlapping plate assembled to the base plate; an oil filter supported in the overlapping plate; and radiation fins formed on the base plate and the overlapping plate, wherein the base plate includes an inlet port for receiving the engine oil discharged from an oil pump of the engine, an outlet groove for outputting the engine oil and a first passage groove connecting the inlet port and the outlet groove, the overlapping plate includes an inlet groove opposed to the inlet port, an outlet port opposed to the outlet groove and a second passage groove opposed to the first passage groove to form an oil passage together with the first passage groove, and the base plate and the overlapping plate having through-holes where the filter outlet of the oil filter passes through for the connection with the crankcase.

16 Claims, 8 Drawing Sheets

OIL COOLING SYSTEM OF AN AIR-COOLED ENGINE

CROSS REFERENCE TO RELATED APPLICATIONS

The disclosure of Japanese Application No. 2005-100519 filed on Mar. 31, 2005 including the specification, drawing and abstract is incorporated herein by reference in its entirety.

FIELD OF THE INVENTION

This invention is related to an oil cooling system for cooling the oil reserved in a crankcase of an engine, preferably the oil cooling system adapted to an air-cooled engine.

BACKGROUND OF THE INVENTION

Engine oil, which is supplied to the sliding portions that require lubrications, is stored in a crankcase of the engine. An air-cooled engine is used in an all-terrain vehicle (so-called as "ATV"). In the air-cooled engine, the engine is cooled by only the wind so that the temperature of the engine oil tends to rise.

To solve this problem, Japanese Patent Laid-Open No. 2002-225574 discloses an air-cooled engine having an oil cooler assembled to the engine body so as to cool the engine oil.

Furthermore, Japanese Patent Laid-Open No. 9-296991 discloses the air-cooled engine having an oil cooler to which an oil filter is directly assembled.

In order to improve the radiation performance of the oil cooler, it is desirable that enough winds blow the oil cooler. However, in the case that the oil filter is directly assembled to the oil cooler, the oil filter prevents the wind from blowing the oil cooler, as a result the cooling performance is not improved.

On the other hand, the oil cooler can be placed at a portion appropriate for cooling by connecting the oil filter and the oil cooler with a pipe. In this structure, however, pipes and connectors are required to assemble the oil cooler and the oil filter to the engine body. For this reason, the oil cooling system will be complicated. This causes not only increasing the assembling time of the engine but also increasing the production cost.

SUMMARY OF THE INVENTION

In view of the above circumstances, the first object of the present invention is to provide the simple structure of the oil cooling system of the air-cooled engine, and to obtain a desirable cooling performance.

According to the present invention, there is provided an oil cooling system of an air-cooled engine for cooling the oil reserved in a crankcase of the engine, the cooling system comprising a base plate assembled to the crankcase, an overlapping plate assembled to the base plate; an oil filter supported in the overlapping plate; and radiation fins formed on the base plate and the overlapping plate, wherein the base plate includes an inlet port for receiving the engine oil discharged from an oil pump of the engine, an outlet groove for outputting the engine oil and a first passage groove connecting the inlet port and the outlet groove, the overlapping plate includes an inlet groove opposed to the inlet port, an outlet port opposed to the outlet groove and a second passage groove opposed to the first passage groove to form an oil passage together with the first passage groove, and the base plate and the overlapping plate having through-holes where the filter outlet of the oil filter passes through for the connection with the crankcase.

It is preferable that the passage groove is formed as a meander shape in the base plate and the overlapping plate.

It is preferable that the base plate and the overlapping plate include a plurality of air holes in the thickness direction so that winds pass through the holes.

It is preferable that the base plate is assembled to the crankcase on its front side in a vehicle running direction.

According to the present invention, there is further provided an oil cooling apparatus of an air-cooled engine for cooling the engine oil stored in a crankcase of the engine, the apparatus comprising a cooling unit assembled to the crankcase and having a pair of half bodies forming therebetween inlet and outlet ports for the engine oil and an oil passage connecting the inlet and outlet ports; an oil filter supported by the cooling unit and connected to the crankcase through the cooling unit, the oil filter being communicated with the outlet port of the cooling unit and having an outlet portion for discharging the engine oil after filtering to the crankcase; and an radiation fins integrated to the cooling unit for cooling the engine oil flowing through the oil passage of the cooling unit.

According to the oil cooling system of this invention, since the oil filter is directly assembled to the oil cooler, and cooled engine oil in the oil cooler can be directly guided to the oil filter.

Furthermore, since the winds can directly blow the oil cooler without being disturbed by the oil filter, the cooling performance can be improved. Therefore, the oil cooling system with compact size and high performance can be achieved in a low cost.

Moreover, since the oil cooler comprises a pair of half bodies such as the base plate and the overlapping plate and the air-holes and the radiation fins are provided on the oil cooler to pass through the wind flows, the cooling performance of the oil cooler can be improved.

DETAILED DESCRIPTION OF THE PREFERRED EMBODIMENTS

A preferred embodiment of the present invention is explained with figures, however, the scope of the invention is not limited by the illustrated embodiments of the figures.

Figure 1:
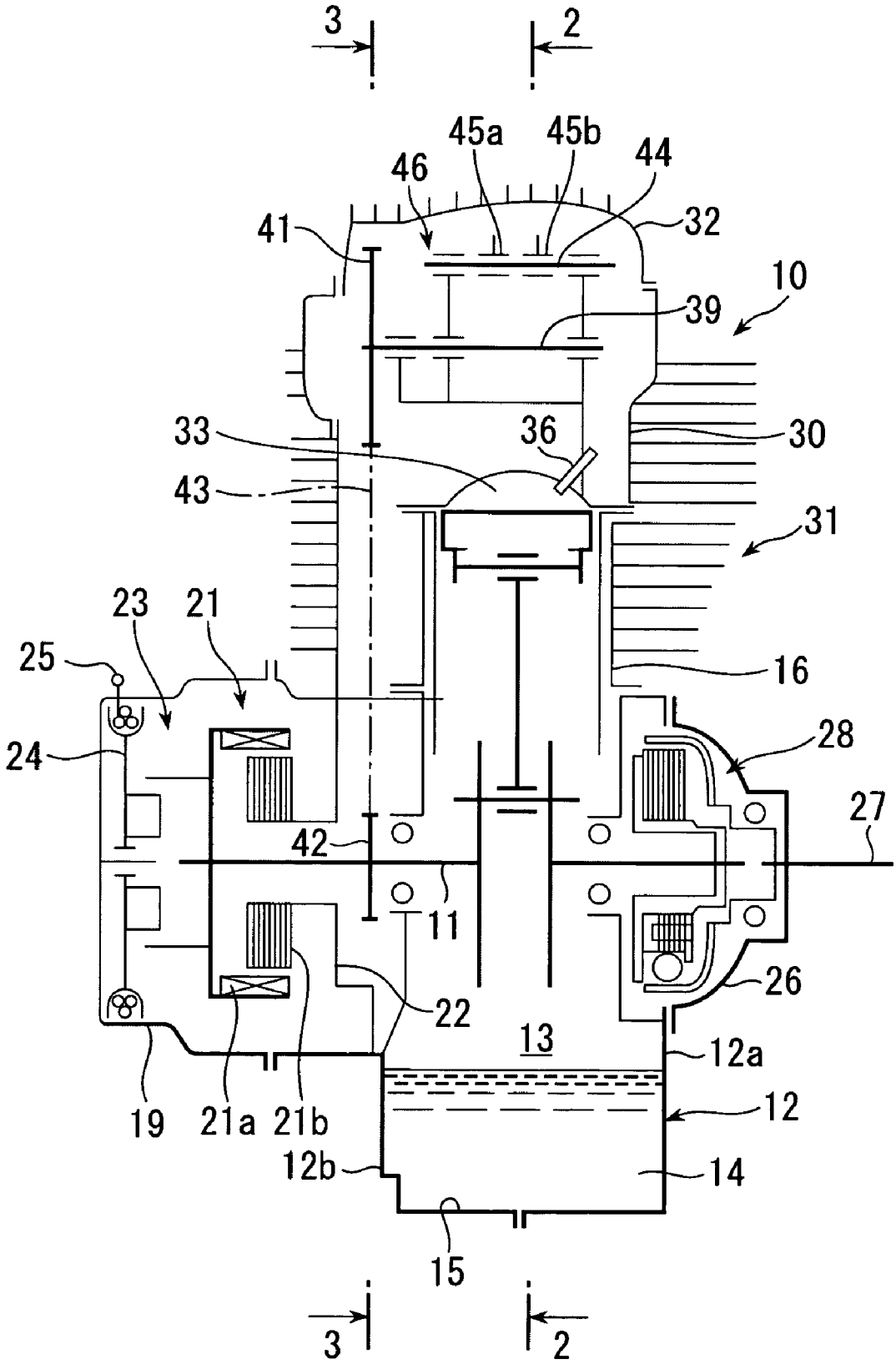
FIG. 1 is a schematic drawing to show an engine.

An engine 10 is used in a vehicle such as an all terrain vehicle (so-called as "ATV"). As shown in FIG. 1, the engine 10 comprises a crankcase 12, a cylinder 16, a cylinder head 30 assembled to the cylinder 16 and other component parts. The crankcase 12 rotatably incorporates a crankshaft 11 inside thereof. The crankcase 12 comprises a first half body 12*a* and a second half body 12*b* which is fixed to the first half body 12*a*. A crank room is formed inside the crankcase 12. The bottom of the crankcase 12 forms an oil pan 15 for reserving the engine oil. The cylinder 16 is assembled to the crankcase 12. A piston 17 is reciprocally incorporated in the cylinder 16. The piston 17 is connected to the crankshaft 11 through a connecting rod 18. Thus, the reciprocal motion of the piston 17 is converted to the rotational motion of the crankshaft 11 through the connection rod 18.

As shown in FIG. 1, an output shaft 27 is rotatably supported by a cover 26 which is fixed to the crankcase 12, coaxially with the crankshaft 11. A centrifugal clutch 28 is incorporated between the crankshaft 11 and the output shaft 27. When the rotational speed of the crankshaft 11 is higher than a predetermined speed, the centrifugal clutch 28 engages the output shaft 27 and the crankshaft 11 by the centrifugal force, thereby to transmit the torque of the crankshaft 11 to the output shaft 27. The output torque of the output shaft 27 is transmitted to drive wheels through a power transmission device (not shown).

Figure 2:
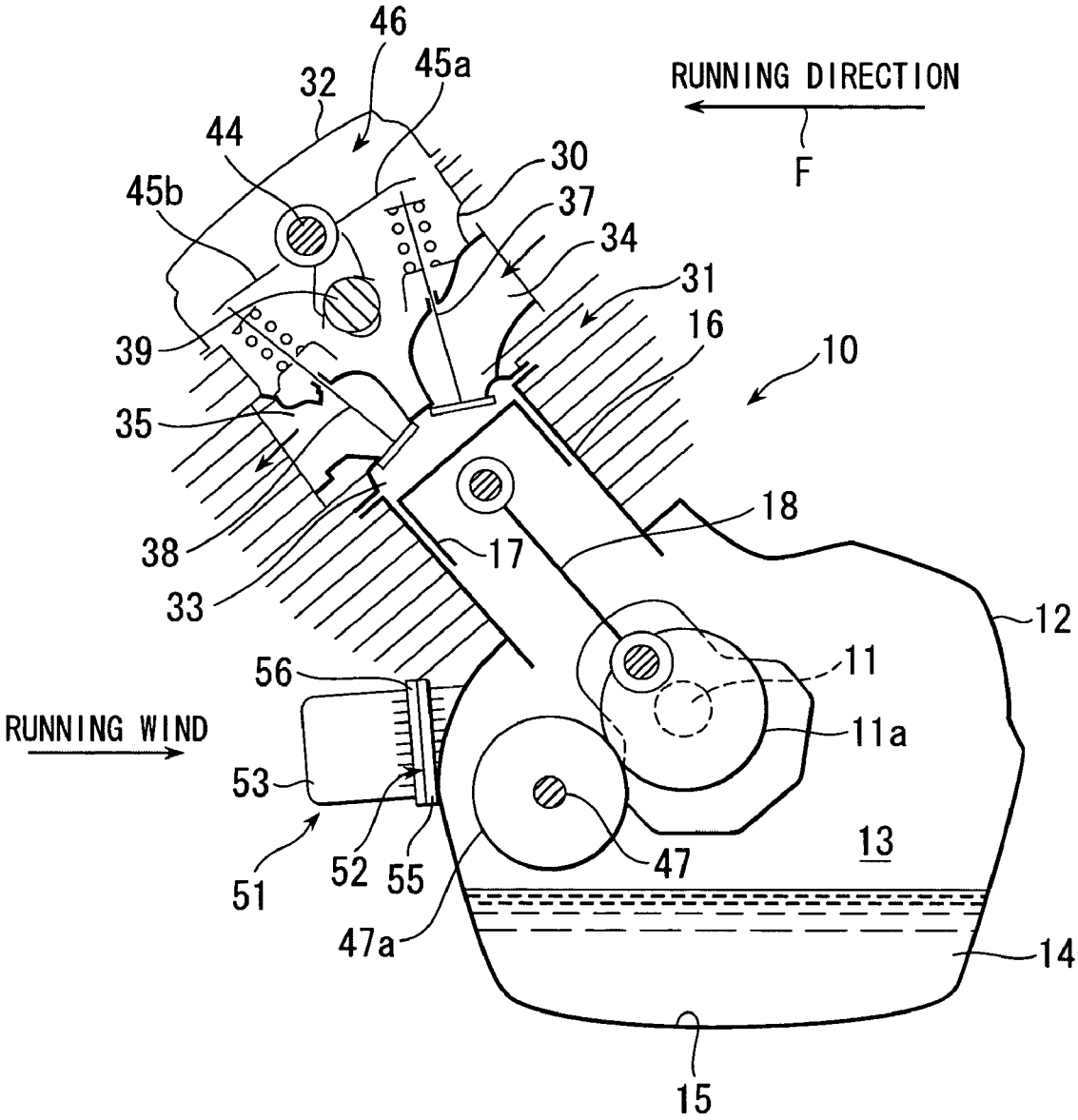
FIG. 2 is a schematic drawing to show cross-sectional view of the engine along the line 2-2 in FIG. 1.
Figure 3:
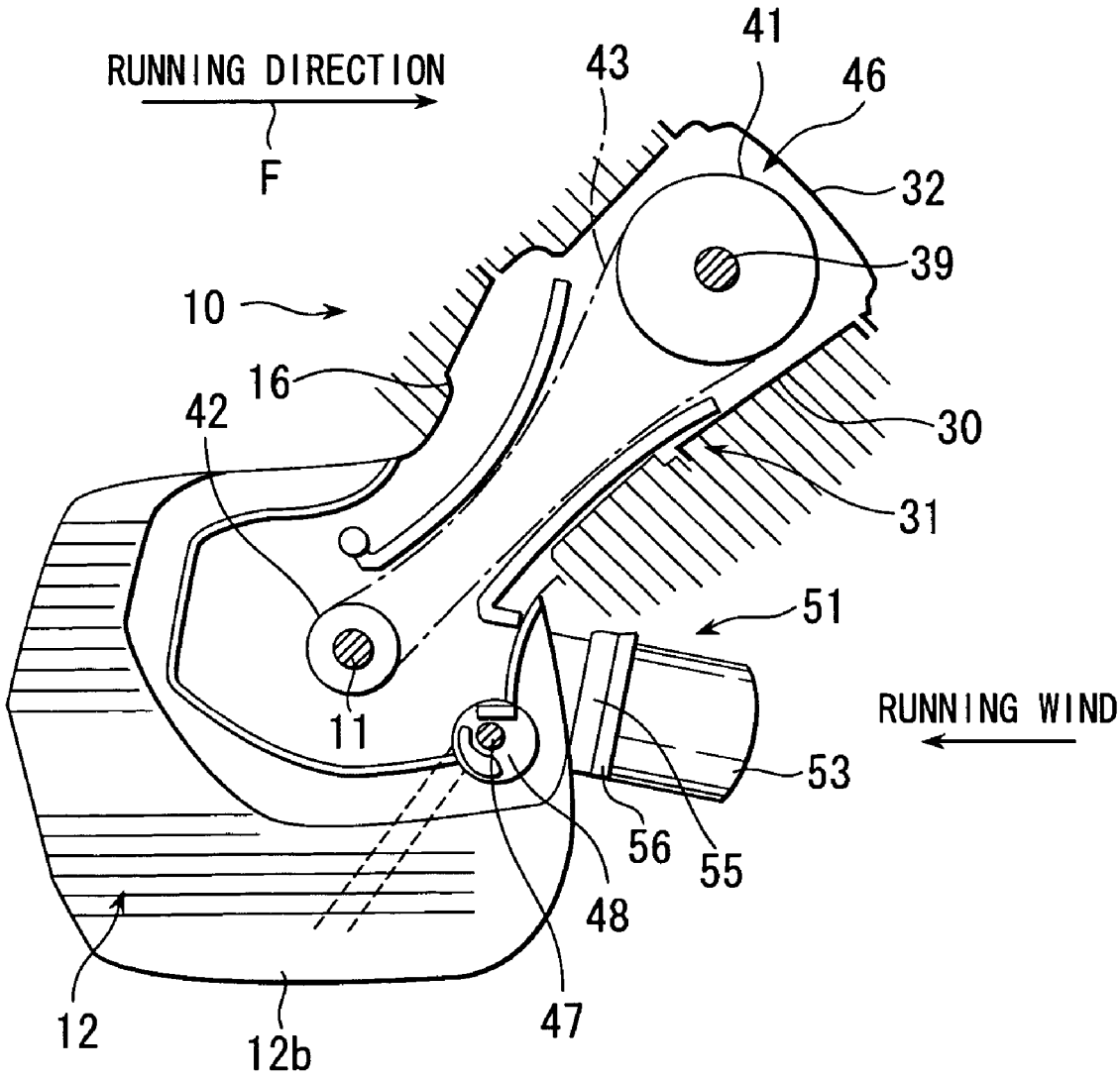
FIG. 3 is a schematic drawing to show cross-sectional view of the engine along the line 3-3 in FIG. 1.

As shown in FIG. 2, a pump drive shaft 47 is rotatably assembled to the crankcase 12. A driven gear 47*a* is secured to the pump drive shaft 47 to mesh with a drive gear 11*a* fixed to the crankshaft 11. As shown in FIG. 3, this pump drive shaft 47 is connected to the oil pump 48 incorporated in the crankcase 12. The engine oil 14 suctioned from the oil pan 15 by the oil pump 48 is supplied to the sliding surfaces between a crankpin of the crankshaft 11 and a connecting rod 18 through an oil passage formed in the crankcase 12. On the other hand, the engine oil 14 is supplied through a oil passage formed in the crankcase 12 and then sprayed to the sliding surfaces of the piston 17 and a cylinder bore. The engine oil 14 is also supplied to a clutch shoe of the centrifugal clutch 28 and any other oil requiring portions, such as a camshaft 39 of a valve operating mechanism 46, through oil passages formed in the crankcase 12.

Figure 4:
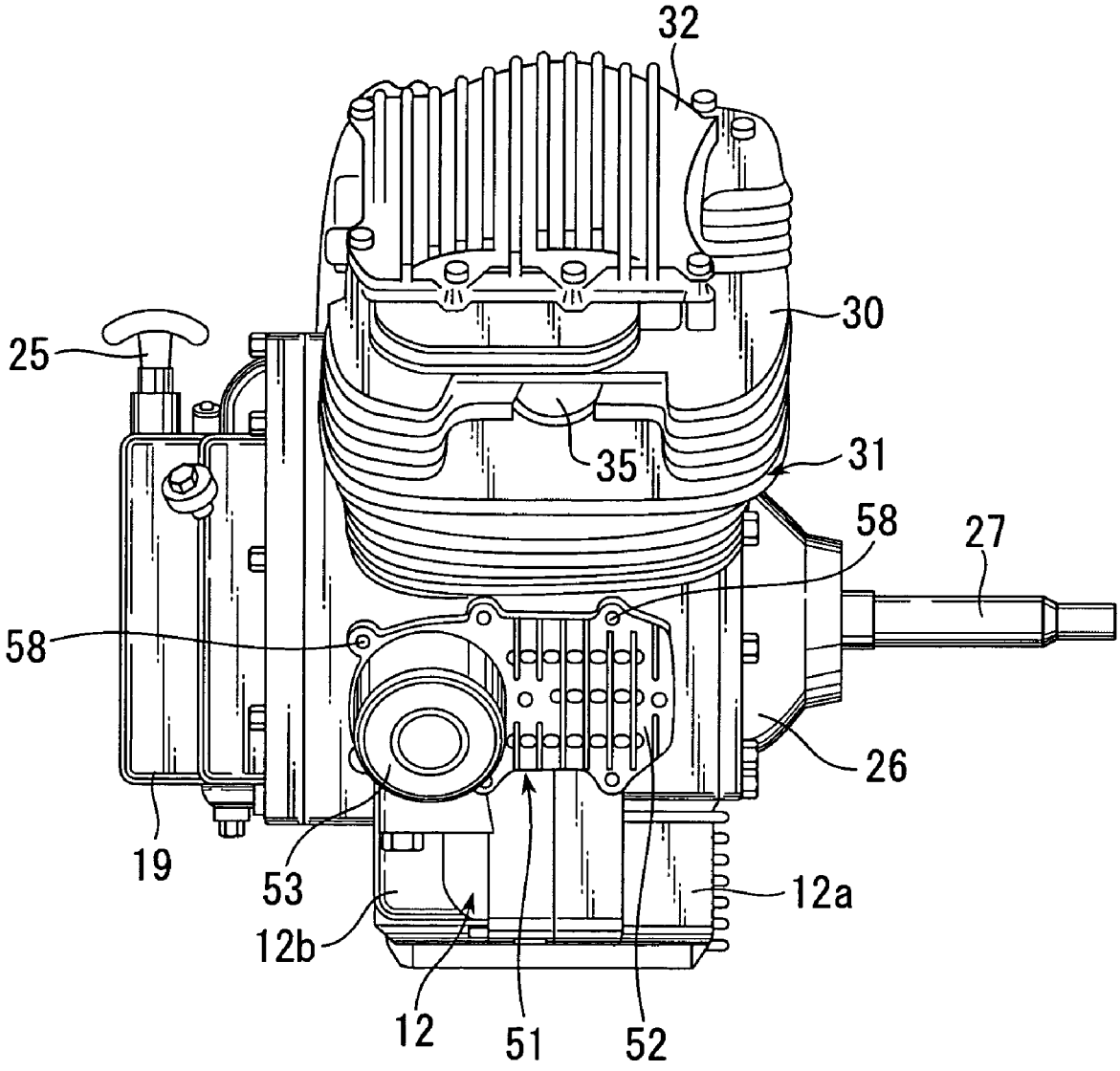
FIG. 4 is front view of the engine represented in FIGS. 1-3.
Figure 6:
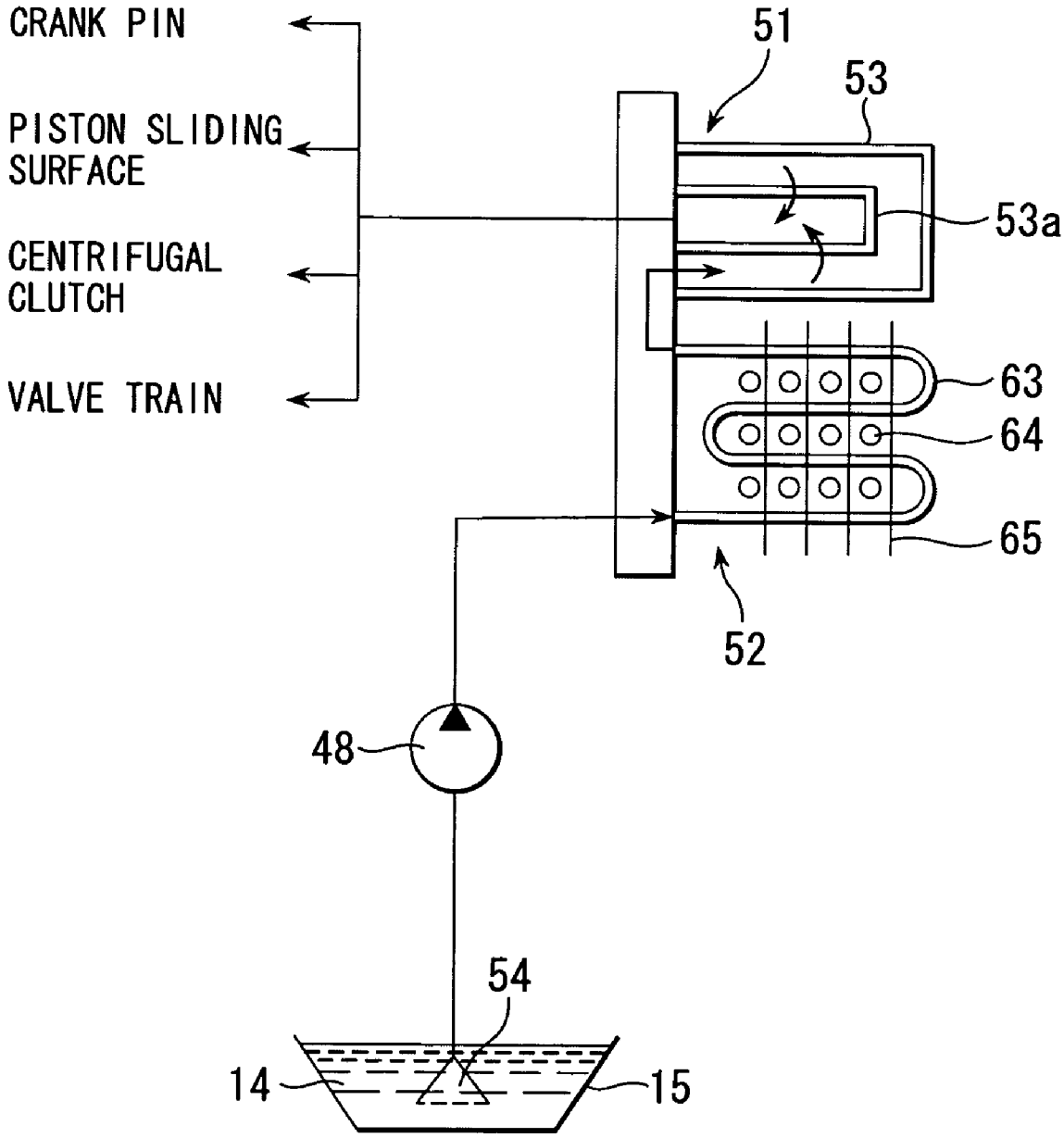
FIG. 6 is schematic drawing to show hydraulic circuit of engine oil flowing through the oil cooling unit.

As shown in FIG. 4, a cooling unit 51 is assembled to the crankcase 12 of the engine 31. More specifically, as shown in FIG. 2 and FIG. 3, the cooling unit 51 is assembled to the front side of the crankcase 12 in the vehicle running direction F. The cooling unit 51 forms an oil cooler 52 on which an oil filter 53 is removably mounted. As shown in FIG. 6 the engine oil flowing into the oil pump 48 through a strainer 54 is supplied to the cooling unit 51. After the engine oil 14 is cooled in the oil cooler 52, the engine oil 14 is filtered by a filter element 53*a* in the oil filter 53 so as to be supplied to oil requiring portions.

Figure 7:
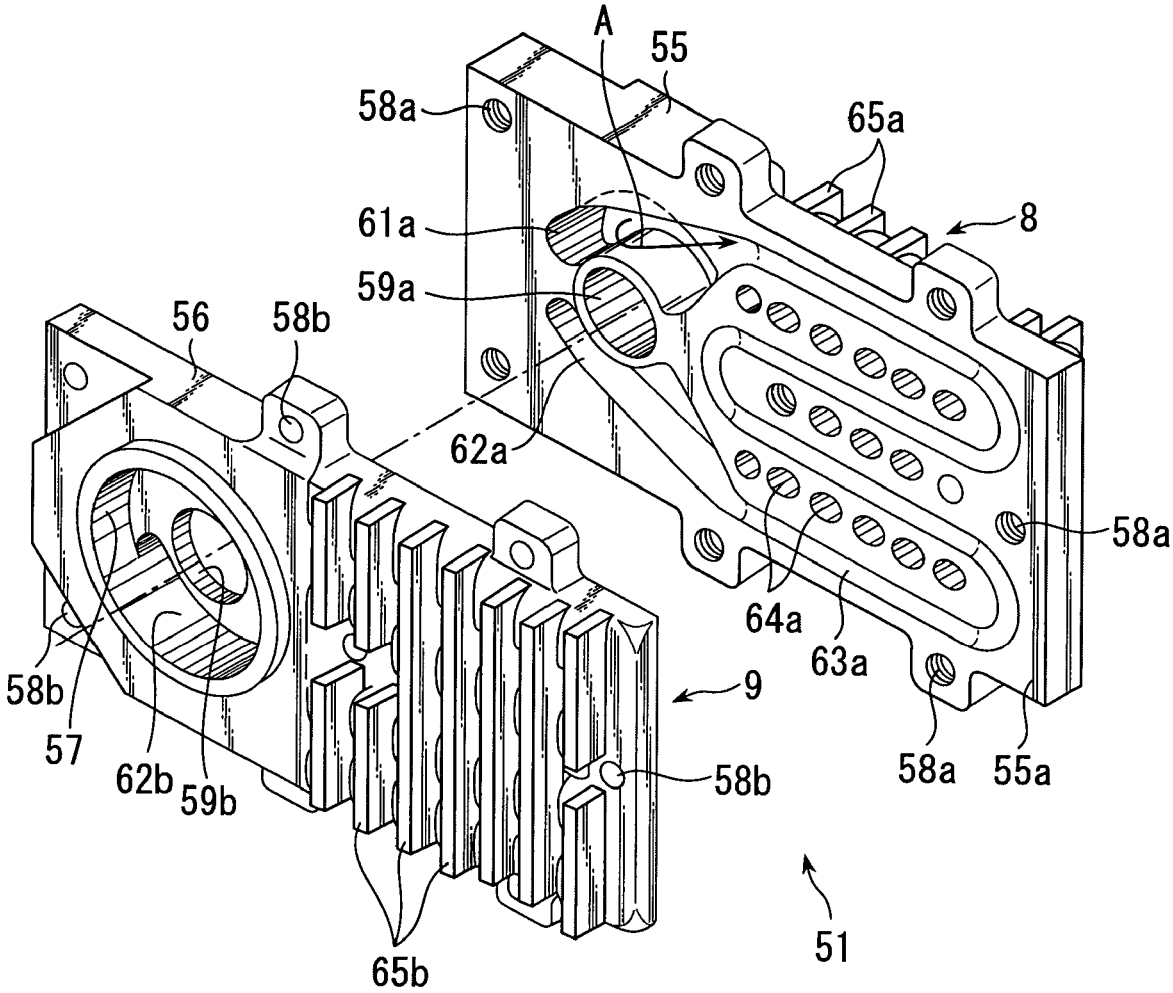
FIG. 7 is exploded perspective view to show a base plate and an overlapping plate as the components of the cooling unit.

The cooling unit 51 comprises a pair of half bodies such as a base plate 55 and an overlapping plate 56. The base plate 55 is formed approximately rectangular shape. An inner surface of the base plate 55 is defined as a flat matching surface 55*a* as shown in FIG. 7. On the other hand, the flat portion is formed in the half area of the outside surface of the base plate 55 to define a mounting surface 55*b* to the crankcase 12 as shown in FIG. 8.

Figure 9:
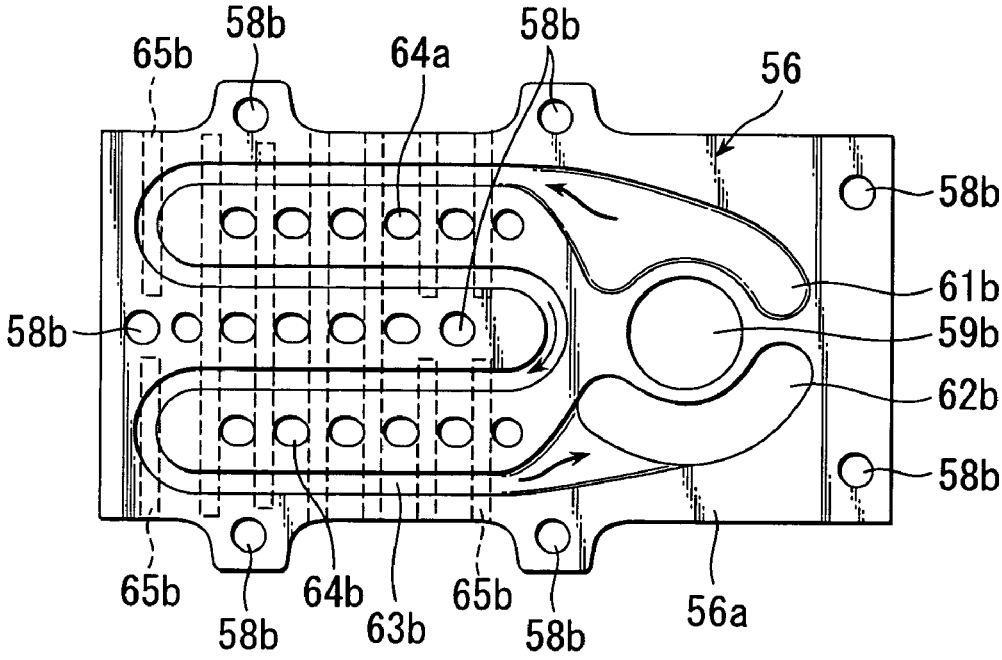
FIG. 9 is front view of the overlapping plate viewed from the direction of an arrow 9 in FIG. 7.

The shape of overlapping plate 56 is corresponding to the base plate 55, as shown in FIG. 9 a flat matching surface 56*a* is formed on an inner surface of the overlapping plate 56, and a filter mounting hole 57 is formed on an outer surface of the overlapping plate 56. The matching surface 56*a* of the overlapping plate 56 and the matching surface 55*a* of the base plate 55 are coupled across a sheet material therebetween to form the cooling unit 51. Both the base plate 55 and the overlapping plate 56 are cast from light-alloy material such as aluminum alloy.

Figure 5:
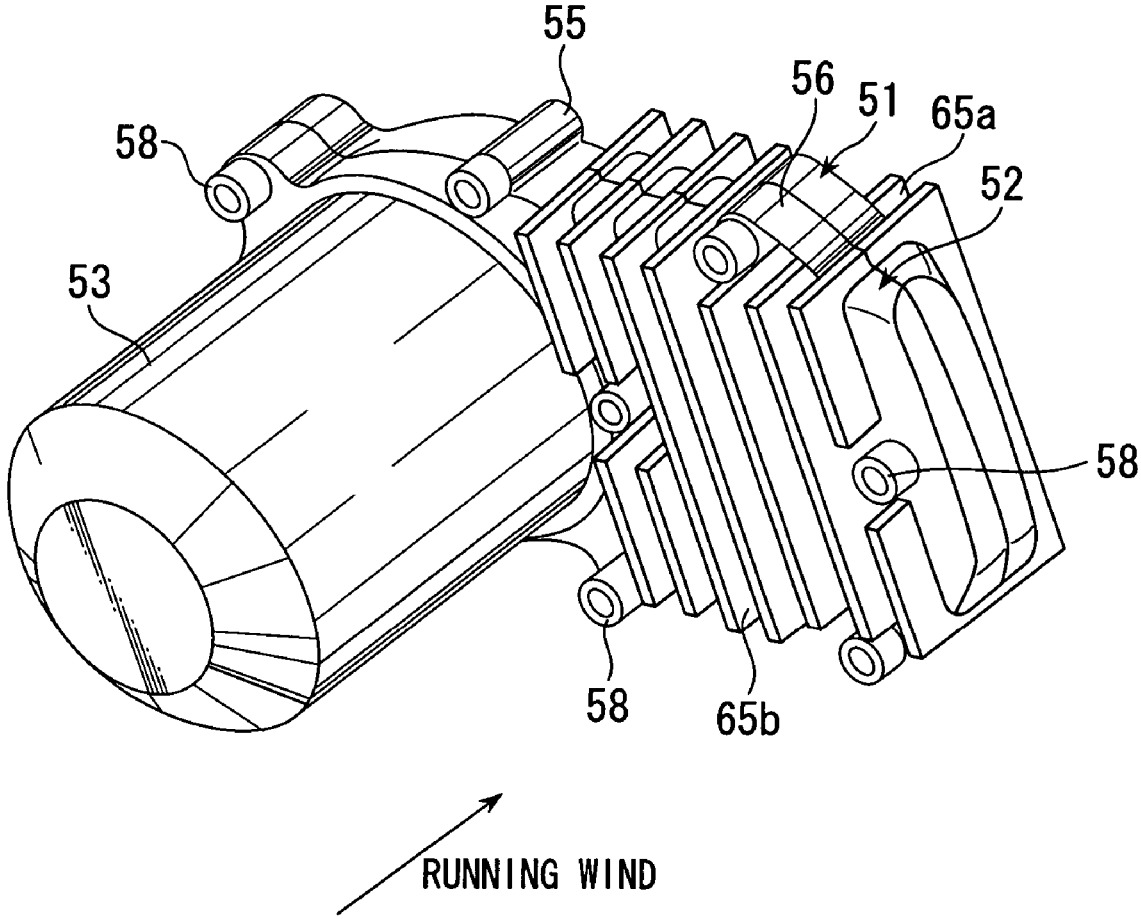
FIG. 5 is enlarged perspective view of an oil cooling unit shown in FIG. 4.

To assemble the overlapping plate 56 to the base plate 55, the base plate 55 has a plurality of tapped holes 58*a*, and the overlapping plate 58 has a plurality of through-holes 58*b* corresponding to the respective tapped holes 58*a*. As shown in FIG. 4 and FIG. 5, the overlapping plate 56 is assembled to the base plate 55 by tightening screws passing through the respective through-holes 58*b* into the respective tapped holes 58*a*. Some of the screws extend through the tapped holes 58*a* so as to be engaged with the crankcase 12 so that the cooling unit 51 is assembled to the crankcase 12.

Figure 8:
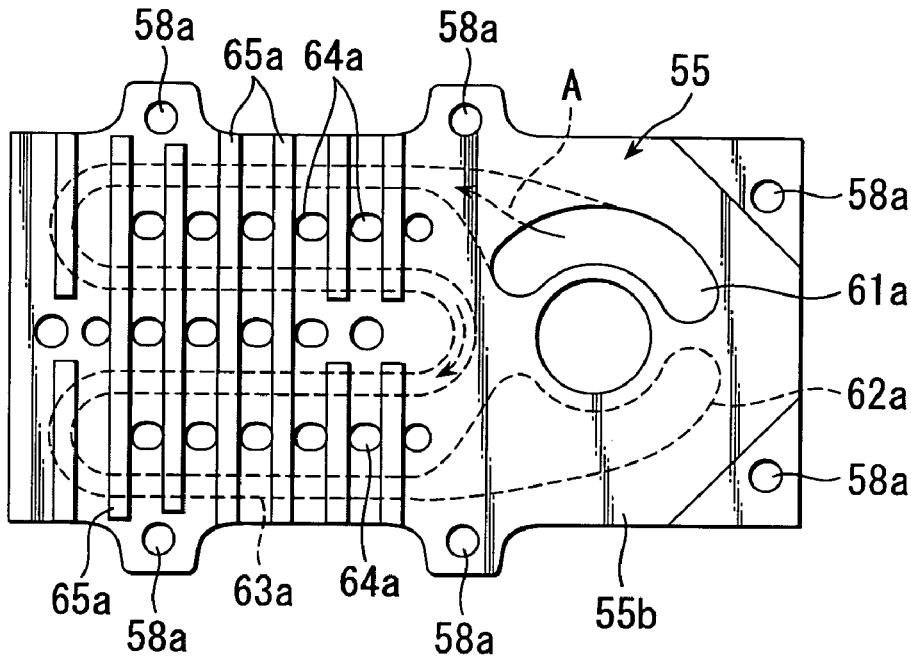
FIG. 8 is front view of the base plate viewed from the direction of an arrow 8 in FIG. 7.

In the middle part of the base plate in the width direction, as shown in FIG. 7 and FIG. 8, a circular through-hole 59*a* to which the outlet of the oil filter 53 is fit, is formed through the base plate 55 in its thickness direction. Furthermore, an inlet port 61*a* shaped in circular arc is formed through the base plate 55 in its thickness direction, surrounding the circular through-hole 59*a*.

The engine oil discharged from the oil pump 48 flows into the inlet port 61*a* as shown in the arrow A. An outlet groove 62*a* is formed in the matching surface 55*a* of the base plate 55 to be opposed to the inlet port 61*a* with respect to the through-hole 59*a*. The outlet groove 62*a* has the bottom surface without penetrating the base plate 55. A passage groove 63*a* (as a first passage groove) is formed in a meander shape between the inlet port 61*a* and the outlet groove 62*a*, as shown in FIG. 7. The passage groove 63*a* has two turning portions near the side edge of the base plate 55, one turning portion at the center of the base plate 55 and four straight portions connecting these turning portions. The straight portions are provided in parallel so as to extend in the longitudinal direction of the base plate 55.

As shown in FIG. 7 and FIG. 9, in the matching surface 56*a* of the overlapping plate 56, a through-hole 59*b* is formed at a position corresponding to the through-hole 59*a* and a inlet groove 61*b* is formed at a position corresponding to the inlet port 61*a*. The inlet groove 61*b* has the bottom surface without penetrating the overlapping plate 56 in the thickness direction. Furthermore, the overlapping plate 56 has an outlet port 62*b* at a position corresponding to the outlet groove 62*a* of the base plate 55, which is formed through the overlapping plate 56 in its thickness direction. As shown in FIG. 9 a passage groove 63*b* (as a second passage groove) is formed in the matching surface 56*a* between the inlet groove 61*b* and the outlet port 62*b*, and also at a position corresponding to the passage groove 63*a*. By engaging the base plate 55 and overlapping plate 56 with a seal material, the oil passage 63 is formed by the passage grooves 63*a* and 63*b* in the cooling unit 51 so as to guide the engine oil 14 discharged from the oil pump 48 to the oil filter 53.

As shown in FIG. 8, the base plate 55 has a plurality of air holes 64*a* in its thickness direction. Those air holes 64*a* are located at respective areas nestled between the adjacent straight portions of the passage groove 63*a* at a predetermined interval along such straight portions. In the overlapping plate 56, an air holes 64*b* is formed at a position corresponding to the respective air holes 64*a* as shown in FIG. 9. By engaging the base plate 55 and the overlapping plate 56, a plurality of air passages 64 as through-holes are formed by the air holes 64*a* and 64*b* in the thickness direction of the cooling unit 51 as shown FIG. 6.

As shown in FIG. 8, at the outer surface of the base plate 55, a plurality of heat radiation fins 65*a* outwardly projecting and extending in the width direction of the base plate 55 are provided. Similarly, as shown in FIG. 7, a plurality of heat radiation fins 65*b* are also provided on the overlapping plate 56.

As described above, the cooling unit 51 is formed by engaging the base plate 55 and the overlapping plate 56 with seal material therebetween and tightened by the screw members 58. When the oil filter 53 is assembled to the cooling unit 51, a case of the oil filter 53 is fit into the filter mounting hole 57 of the cooling unit 51 and an outlet portion of the oil filter 53 passing though the through-holes 59*a* and 59*b* is screwed firmly into the crankcase 12. Therefore, the oil filter 53 can be removably assembled to the cooling unit 51 and the crankcase 12.

As described above, the cooling unit 51 acts as a support member to assemble the oil filter 53 to the crankcase 12. Since the cooling unit 51 is assembled to the front face of the crankcase 12 in the vehicle running direction, the winds directly blow the outside surface and the heat radiation fins 56*b* of the overlapping plate 55 while the vehicle is running. Therefore, the air flows into the air holes 64*a* and 64*b*, and then flows into a clearance between the cooling unit 51 and the crankcase 12. Accordingly, the engine oil 14 is cooled by the winds while flowing through the oil passage 63 formed by the passage grooves 63*a* and 63*b* of the cooling unit 51 Thus, the cooled engine oil flows into the oil filter 53 to be filtered.

As described above, since the cooling unit 51 is formed by coupling two half plates, the radiating efficiency ratio can be improved. Furthermore, since the oil filter 53 is supported by the cooling unit 51, additional pipes and connectors are not required for the connection of the oil filter 53 and the oil cooler 52, thereby to reduce the production cost of the cooling unit 51.

The present invention is not limited by detailed description of the preferred embodiment. It can be changed in the range which does not deviate from the gist in various ways. For example, the described preferred embodiment show the air-cooled engine for the boggy car that is ATV (All Terrain Vehicle), however, the present invention can be applied to another type of vehicles such as two-wheeled vehicle.

What is claimed is:

1. An oil cooling system of an air-cooled engine for cooling the engine oil reserved in a crankcase of said engine, said cooling system comprising:

a base plate assembled to said crankcase;

an overlapping plate assembled to said base plate;

an oil filter supported in said overlapping plate; and radiation fins formed on said base plate and said overlapping plate, wherein said base plate includes an inlet port for receiving the engine oil discharged from an oil pump of the engine, an outlet groove for outputting the engine oil and a first passage groove connecting said inlet port and said outlet groove, said overlapping plate includes an inlet groove opposed to said inlet port, an outlet port opposed to said outlet groove and a second passage groove opposed to said first passage groove to form an oil passage together with said first passage groove, said base plate and said overlapping plate having through-holes where the filter outlet of said oil filter passes through for the connection with said crankcase, and said base plate and said overlapping plate include a plurality of air holes in the thickness direction so as to pass the wind through said air holes.

2. The oil cooling system according to claim 1, wherein said first and second passage grooves are formed as a meander shape in said base plate and the overlapping plate.

3. The oil cooling system according to claim 1, wherein said base plate is assembled to said crankcase on its front side in a vehicle running direction.

4. An oil cooling apparatus of an air-cooled engine for cooling the engine oil stored in a crankcase of the engine, said apparatus comprising:

a cooling unit assembled to the crankcase and having a pair of half bodies forming therebetween inlet and outlet ports for the engine oil and an oil passage connecting said inlet and outlet ports;

an oil filter supported by said cooling unit and connected to the crankcase through said cooling unit, said oil filter being communicated with the outlet port of said cooling unit and having an outlet portion for discharging the engine oil after filtering to the crankcase; and an radiation fins integrated to said cooling unit for cooling the engine oil flowing through the oil passage of said cooling unit, wherein said cooling unit includes a plurality of air through-holes formed through the half bodies of said cooling unit for the passage of air.

5. The oil cooling apparatus according to claim 4, wherein said cooling unit includes a filter mounting hole for mounting said oil filter and a through-hole provided to lead the filter outlet of said oil filter for the connection with said crankcase.

6. An oil cooling apparatus of an air-cooled engine for cooling the engine oil stored in a crankcase of the engine, said apparatus comprising:

a cooling unit assembled to the crankcase and having a pair of half bodies forming therebetween inlet and outlet ports for the engine oil and an oil passage connecting said inlet and outlet ports; and an oil filter connected to the crankcase through said cooling unit, said oil filter being communicated with the outlet port of said cooling unit and having an outlet portion for discharging the engine oil after filtering to the crankcase, wherein said cooling unit includes a plurality of air through-holes formed through the half bodies of said cooling unit for the passage of air.

7. The oil cooling apparatus according to claim 6, wherein said cooling unit includes a filter mounting hole for mounting said oil filter and a through-hole provided to lead the filter outlet of said oil filter for the connection with said crankcase.

8. The oil cooling apparatus according to claim 6, wherein said oil passage is formed as a meander shape in said cooling unit.

9. The oil cooling apparatus according to claim 6, wherein said cooling unit is assembled to said crankcase on its front side in a vehicle running direction.

10. The oil cooling apparatus according to claim 6, further comprising:

a radiator fins integrated to said cooling unit for cooling the engine oil flowing through the oil passage of said cooling unit.

11. The oil cooling apparatus according to claim 6, wherein said oil passage is formed as a meander shape in said cooling unit to meander among said plurality of air-through holes.

12. The oil cooling apparatus according to claim 6, wherein said air-through hole is formed between adjacent straight portions of said oil passage.

13. The oil cooling apparatus according to claim 10, wherein said air-through is formed between said radiator fins.

14. An oil cooling unit for an air-cooled engine for cooling the engine oil reserved in a crankcase of said engine, said cooling unit comprising:

a base plate;

an overlapping plate assembled to said base plate;

an oil filter supported in said overlapping plate; and radiation fins formed on said base plate and said overlapping plate, wherein said base plate includes an inlet port for receiving the engine oil discharged from an oil pump of the engine, an outlet groove for outputting the engine oil and a first passage groove connecting said inlet port and said outlet groove, said overlapping plate includes an inlet groove opposed to said inlet port, an outlet port opposed to said outlet groove and a second passage groove opposed to said first passage groove to form an oil passage together with said first passage groove, said base plate and said overlapping plate having through-holes where the filter outlet of said oil filter passes through for the connection with said crankcase, and said base plate and said overlapping plate include a plurality of coincident air holes through the base plate and overlapping plate so as to pass wind through said air holes.

15. The oil cooling system according to claim 14, wherein said first and second passage grooves are formed as a meander shape in said base plate and the overlapping plate.

16. An air-cooled engine having an oil cooling apparatus for cooling the engine oil stored in a crankcase of the engine, said apparatus comprising:

a cooling unit assembled to the crankcase and having a pair of half bodies forming therebetween inlet and outlet ports for the engine oil and an oil passage connecting said inlet and outlet ports;

an oil filter supported by said cooling unit and connected to the crankcase through said cooling unit, said oil filter being in communication with the outlet port of said cooling unit and having an outlet portion for discharging the engine oil after filtering to the crankcase; and a plurality of radiation fins integral with said cooling unit for cooling the engine oil flowing through the oil passage of said cooling unit, wherein said cooling unit includes a plurality of air through-holes formed through the half bodies of said cooling unit for the passage of air.

* * * * *